US007618288B1

(12) United States Patent
DiFusco

(10) Patent No.: US 7,618,288 B1
(45) Date of Patent: Nov. 17, 2009

(54) QUICK CONNECT SPRING-CLAMP LIGHT BULB SOCKET

(76) Inventor: Frank DiFusco, 86 Wimmer Rd., Hopewell Junction, NJ (US) 12533

( * ) Notice: Subject to any disclaimer, the term of this patent is extended or adjusted under 35 U.S.C. 154(b) by 0 days.

(21) Appl. No.: 11/680,730

(22) Filed: Mar. 1, 2007

(51) Int. Cl.
*H01R 13/40* (2006.01)

(52) U.S. Cl. ..... 439/602; 439/356; 439/253

(58) Field of Classification Search ..... 439/602, 439/180, 253, 256, 257, 336, 618
See application file for complete search history.

(56) References Cited

U.S. PATENT DOCUMENTS 1,721,365 A * 7/1929 Zwetsch ..... 439/253
3,895,195 A 7/1975 Morrison
3,915,536 A 10/1975 Glantz
3,936,122 A 2/1976 Hagelberg
4,222,623 A 9/1980 Hultberg
4,279,458 A 7/1981 Knapp
4,319,796 A 3/1982 Wiley
4,548,449 A * 10/1985 Corsetti ..... 439/641
4,768,966 A 9/1988 Doherty
4,778,409 A 10/1988 Maddock
4,825,393 A 4/1989 Armbruster
4,883,434 A * 11/1989 Toyoshima ..... 439/619
5,030,124 A 7/1991 Lorentzon
5,154,628 A * 10/1992 Skegin ..... 439/336
5,171,292 A * 12/1992 Ortiz ..... 439/253
5,278,741 A 1/1994 Ehrman
5,380,214 A * 1/1995 Ortega, Jr. ..... 439/253
5,456,611 A 10/1995 Henry
5,595,513 A 1/1997 Kondo
5,743,758 A 4/1998 Cheng
5,800,212 A 9/1998 Hsu
5,989,070 A 11/1999 Al-Turki
6,322,380 B1 11/2001 Conroy
6,491,534 B1 12/2002 Bonard
6,652,305 B1 11/2003 DiFusco
7,413,456 B1 * 8/2008 DiFusco ..... 439/257

* cited by examiner

*Primary Examiner*—Edwin A. Leon
*Assistant Examiner*—Vanessa Girardi
(74) *Attorney, Agent, or Firm*—Michael I Kroll

(57) ABSTRACT

A socket for a light bulb having a socket housing to provide wired connection and an interior spring-clamp socket manufactured of a resilient material and having a notched separation extending longitudinally therethrough. The notch permits the deformation of the spring-clamp socket and expands when a light bulb is inserted and grasps it once therein. Removal of the bulb simply requires pulling the bulb straight out. Additionally the present invention is adaptable and replaceable for most existing lighting fixtures or applications.

5 Claims, 12 Drawing Sheets

QUICK CONNECT SPRING-CLAMP LIGHT BULB SOCKET

BACKGROUND OF THE INVENTION

1. Field of the Invention

The present invention relates generally to electrical sockets and, more specifically, to a light bulb socket having an improved and expedient means of connection whereby the user may insert into place and establish electrical connection to a light bulb by simply inserting said light bulb into a spring-clamp socket with no rotational manipulation, furthermore the user may also remove a light bulb from the present invention by an opposed pulling action.

The present invention is a socket housing providing a base for electrical installation and wire contact and supplying power to a spring-clamp socket fabricated of a resilient material. The diameter of the spring-clamp socket is substantially similar to that of the threaded base of a conventional light bulb and includes a slot extending longitudinally through the side thereof. The slot gives the spring-clamp socket slightly deformable properties wherein insertion of the bulb base causes the socket to expand a bit to accept the bulb therein. This provides a frictional engagement that will maintain the light bulb in place without the need of threading or turning the bulb. The bulb will remain firmly therein until the user pulls it out.

2. Description of the Prior Art

There are other light sockets designed for installing and removing light bulbs. Typical of these is U.S. Pat. No. 5,380,214 issued to Ortega on Jan. 10, 1995.

Another patent was issued to Ehrman on Jan. 11, 1994 as U.S. Pat. No. 5,278,741. Yet another U.S. Pat. No. 5,154,628 was issued to Skegin on Oct. 13, 1992 and still yet another was issued on Nov. 28, 1989 to Toyoshima et al. as U.S. Pat. No. 4,883,434.

Another patent was issued to Maddock et al on Oct. 18, 1988 as U.S. Pat. No. 4,778,409. Another patent was issued to Wiley et al on Mar. 16, 1982 as U.S. Pat. No. 4,319,796. Another patent was issued to Al-Turki et al on Nov. 23, 1999 as U.S. Pat. No. 5,989,070. Another patent was issued to Hsu et al on Sep. 1, 1998 as U.S. Pat. No. 5,800,212. Another patent was issued to Kondo et al on Jan. 21, 1997 as U.S. Pat. No. 5,595,513. Another patent was issued to Armbruster et al on Apr. 25, 1989 as U.S. Pat. No. 4,824,393.

Another patent was issued to Morrison et al on Jul. 15, 1975 as U.S. Pat. No. 3,895,195. Another patent was issued to Glantz on Oct. 28, 1975 as U.S. Pat. No. 3,915,536. Another patent was issued to Hagelberg on Feb. 3, 1976 as U.S. Pat. No. 3,936,122. Another patent was issued to Hultberg on Sep. 16, 1980 as U.S. Pat. No. 4,222,623. Another patent was issued to Knapp on Jul. 21, 1981 as U.S. Pat. No. 4,279,458. Another patent was issued to Eisert et al on Oct. 22, 1985 as U.S. Pat. No. 4,548,499.

Still another patent was issued to Doherty on Sep. 6, 1988 as U.S. Pat. No. 4,768,966. Another patent was issued to Lorentzon on Jul. 9, 1991 as U.S. Pat. No. 5,030,124. Another patent was issued to Henry on Oct. 10, 1995 as U.S. Pat. No. 5,456,611. Another patent was issued to Kondo on Jan. 21, 1997 as U.S. Pat. No. 5,595,513. Another patent was issued to Cheng on Apr. 28, 1998 as U.S. Pat. No. 5,743,758. Another patent was issued to Conroy on Nov. 27, 2001 as U.S. Pat. No. 6,322,380. Still yet another patent was issued to DiFusco on Nov. 25, 2003 as U.S. Pat. No. 6,652,305.

U.S. Pat. No. 3,895,195

Inventor: Morrison

Issued: Jul. 15, 1975

A shock proof electrical lightbulb socket which generally includes a body, a positive terminal and a negative terminal mounted on the body for electrical connection to an electrical power line, and a lightbulb receiver mounted within the body having an open top and a closed bottom for receiving the end of a lightbulb. The lightbulb receiver includes an internally threaded open ended electrically conductive shell adapted to contact the conductive sleeve of the lightbulb and the negative terminal, and a base contact at the bottom of the receiver which is adapted to contact the bottom contact of the lightbulb and the positive terminal. The shell and bottom contacts are normally spaced from the respective terminals when a lightbulb is not fully screwed into the receiver. In one embodiment the socket includes a circuit completion mechanism movably mounted between the receiver and the body of the socket for establishing a circuit only in response to the insertion of a lightbulb into the receiver to move the circuit completion mechanism. In another embodiment, the interior of the body and the outside of the receiver have mating threads formed thereon so that the receiver can be threadably reciprocably moved relative to the body. The circuit can be completed only by threadably moving the contacts of the receiver to contact the terminals by rotating the lightbulb. In still another embodiment, the base contact is secured to the body, and the lightbulb receiver is mounted for reciprocal movement within the body relative to the body and base. The lightbulb receiver has downwardly extending portions which are adapted to engage terminals mounted below the base contact. As the lightbulb is screwed into the receiver, the receiver is moved outwardly relative to the socket thereby causing completion of the circuit U.S. Pat. No. 3,915,536

Inventor: Glantz

Issued: Oct. 28, 1975

A holder for an electric lamp which comprises a first contact element guided for movement through a plug of insulating material separating the lamp opening of the holder from the terminals, and furthermore comprises a second contact element located laterally of and in spaced relationship to the first contact element while being connected thereto to be brought into contact with its corresponding terminal as a result of the movement of the first contact element caused by introduction of the lamp. The first contact element on the side of the plug of insulating material which is facing away from the lamp opening and by means of an insulating carrier carries the second contact element so as to make the latter tiltable and restrictedly displaceable along the axis of the lamp holder. The terminal corresponding to the second contact element and a lateral contact spring leading to the side of the plug of insulating material facing the lamp opening are each provided at points spaced from each other, with a conductive support point for the second contact element which latter is forced against the support points when making contact. When full contact pressure has been achieved, the terminal leading to the first contact element is situated at a lower level relative to the support points of the second contact element than is the case when there is no contact pressure U.S. Pat. No. 3,936,122

Inventor: Hagelberg

Issued: Feb. 3, 1976

The present invention relates to a safety device in electrical connection devices, especially lamp-holders, comprising a number of contact parts designed to rest against an object arranged to be connected to the connection device, for example a light bulb socket, and a number of elements arranged to be connected to the electric leads of a cable, whereby the contact parts are at a distance from the respective connector elements and are arranged by means of being pushed in by a spring function to achieve contact with these during connection of said object to the device. According to the invention the device is provided with at least one insulating element, forced to be between the contact parts and the respective connector elements and thereby prevent contact between these when said object is removed from the connection device, and simultaneously arranged to be moved by means of the object during its connection to a position in which the contact parts and the respective connector elements are free from the insulating element to be pressed against each other by means of the object by its connection U.S. Pat. No. 4,222,623

Inventor: Hultberg

Issued: Sep. 16, 1980

This invention relates to a holder for a glow-lamp or a bulb and comprises internally in said holder a switch mechanism which on its side facing the bulb has contacts for providing electric contact with the contact surfaces of the lamp base, and which has terminals for the conductors connected to the holder, the electric connection between the terminals and the contacts being interruptible when removing the bulb from the holder U.S. Pat. No. 4,279,458

Inventor: Knapp

Issued: Jul. 21, 1981

A releasable electrical connector consisting of a connector plug mating with a corresponding connector receptacle which may be disconnected by a separating force applied to a surrounding operating sleeve and the connector receptacle. The operating sleeve is shifted axially by the separating force against the bias of compression springs to a release position. The springs are received within grooves formed along the exterior of a segmented spring retaining housing, the segments forming an anchoring flange disposed within a recess formed about the connector plug. A plurality of arcuate threaded coupling segments assembled within the operating sleeve provide a threaded coupling, which segments in the nonreleasing position of the operating sleeve are positioned radially inward to mate with a corresponding thread on the receptacle and serve to create a mating force between the receptacle and plug upon rotation of the operating sleeve and to retain the connector and plug in the connected position. In the releasing position of the operating sleeve, the arcuate coupling segments are moved radially outward into a pair of axially spaced recesses by a camming action occurring between the mating threads on the receptacle and segments to allow the release of the receptacle from the plug. Anti-vibration springs are provided on a plurality of arcuate segments which engage ratchet teeth formed on the exterior of the connector plug to prevent vibration-induced unthreading of the arcuate segments and plug.

U.S. Pat. No. 4,548,449

Inventor: Corsetti

Issued: Oct. 22, 1985

A lamp socket attachment to convert a conventional screw-type light bulb socket into a spring insert type socket comprises a hollow cylindrical member open at both ends made of electrically non-conductive material divided by a transverse partition into upper and lower cup-like compartments, a cylindrical plug made of electrically non-conductive material is fixed concentrically in the lower compartment, there is a bore centrally through the plug and the partition, a contact member made of electrically conductive material slides captive in the bore, the contact member being adjustable in length, and there is a conductor member made of electrically conductive material having a lower portion extending along the outside of the plug through the partition and an upper portion extending along the inside surface of the upper compartment, such conductor member being structured so its lower portion will engage the threads of a screw-type bulb socket when the plug is inserted into the bulb socket and its upper portion will engage the threads of a conventional screw base light bulb inserted into the upper compartment of the lamp socket attachment.

U.S. Pat. No. 4,768,966

Inventor: Doherty

Issued: Sep. 6, 1988

A lampholder for a screw-in lightbulb has a body supporting two cable terminals for connection to an electrical supply, and a contact carrier mounted on the body and defining a bulb receiving socket, the contact carrier being movable between first and second positions relative to the body in a direction parallel to the insertion direction of a bulb and supporting terminals which connect an inserted bulb to the cable terminals when the carrier is in the first position but are spaced from the cable terminals when the carrier is in the second position. A spring pushes the carrier to the second position. When a bulb is screwed part-way into the carrier socket it bears against a fixed abutment so that the carrier is moved from the second to the first positions as the bulb is screwed fully into the socket. Each cable terminal overlaps with a respective carrier terminal in the axial direction and an insulating support is provided which is fixed in position relative to one terminal of each cable/contact terminal pair. The insulating support is such that as the carrier moves from the first to the second positions the terminal which moves is moved onto the partition and out of contact with the other terminal U.S. Pat. No. 5,030,124

Inventor: Lorentzon

Issued: Jul. 9, 1991

When screwing in a bulb into the lamp-holder according to the invention, which is carried out in an axially somewhat movable, threaded yoke (4), initially, via one of two resilient contacts (20, 21) associated with contacts (19) provided on an outer plate (15) which is somewhat movable with respect to the yoke, the outer plate and an inner plate (9) provided with a pair of contacts (12) and immovable with respect to the yoke, are pressed towards each other until a stop (7a, 7b) on the lamp-holder housing (1) arrests the outer plate or the yoke before the pairs of contacts are brought together. By the continued threading motion of the bulb and by the fact that now the outer plate or the yoke are immovable with respect to the housing the plates are moved towards each other until their contact pairs are brought together and the yoke or the outer plate is arrested by the said stop. The contact pairs cannot be brought together by an object without it cooperating with the thread (5) of the yoke.

U.S. Pat. No. 5,456,611

Inventor: Henry

Issued: Oct. 10, 1995

This invention in its preferred embodiment, is directed to a miniature UHF type plug, more particularly to a female, snap-on coaxial cable connector for use with radio-frequency and other transmission lines, where such connector is electrically connectable to a male, receptacle connector, typically panel mounted and of a design as known in the art. The snap-on, coaxial connector comprises three primary members identified as a circular sleeve, a circular shell, and a circular collar. The circular sleeve includes a plurality of spaced-apart, axially oriented tynes along a first end thereof, and the circular shell consists of a cable crimping section, an intermediate section to be received within the sleeve, and a third section having a like plurality of spaced-apart, axially oriented tynes. The latter tynes are arranged to intermate with the first tynes, and the intermated tynes are adapted to receive the male, receptacle connector. The shell is further characterized by means to retain the axial position of the shell within said sleeve, and by means cooperating with the male, receptacle connector to prevent rotative movement therebetween, where preferably such means comprise a compliant, elastomeric spacer member. The circular retaining collar is provided to receive the sleeve, and cooperative means are further provided between the collar and the sleeve to limit the axial movement therebetween.

U.S. Pat. No. 5,595,513

Inventor: Kondo

Issued: Jan. 21, 1997

A bulb socket terminal to be accommodated in a socket body of a connector bulb socket. The terminal includes a base, an elastic contact portion adapted to contact a filament or an earth of a bulb on one side of the base, and a connecting portion adapted to be connected to a connector on the other side thereof. The bulb socket terminal is integrally formed intermediate of the elastic contact portion and the connecting portion with a resin flow blocking wail which contacts an insert-molding metal mold to seal an area of the elastic contact portion at the time of insert-molding. Accordingly, the area where the elastic contact portion extends is sealed by the rein flow blocking wall at the time of insert-molding with use of the metal mold to thereby prevent the resin from flowing into this area. Therefore, the spring elasticity of the elastic contact portion will not be restricted.

U.S. Pat. No. 5,743,758

Inventor: Cheng

Issued: Apr. 28, 1998

A lamp socket in which the socket body is formed of two symmetrical halves connected together a dovetail joint; a rubber packing ring is mounted around the bottom lamp hole of the socket body to prohibit water from passing to the inside of the socket body after the installation of the lamp bulb; a movable metal contact plate is suspending inside the socket body and adapted for connecting the tip contact of the lamp bulb to the positive metal contact plate upon the insertion of the lamp bulb in the socket body; a spring is mounted inside the socket body to force the movable metal contact plate downwardly away from the positive metal contact plate after the removal of the lamp bulb.

U.S. Pat. No. 6,322,380

Inventor: Conroy

Issued: Nov. 27, 2001

A safety light socket including a cylindrical socket defined by an upper end, a lower end, and a cylindrical side wall therebetween. The cylindrical socket includes a cylindrical recess extending downwardly of the upper end thereof. The cylindrical recess includes an open upper end, a closed lower end, and an interior cylindrical wall therebetween. The interior cylindrical wall is threaded for receiving a light bulb. The closed lower end of the cylindrical recess has a spring extending upwardly therefrom. A primary contact is secured to the spring of the cylindrical recess of the cylindrical socket. A secondary contact is secured to the closed lower end of the cylindrical recess of the cylindrical socket U.S. Pat. No. 6,491,534

Inventor: Bonard

Issued: Dec. 10, 2002

A socket for an electric light is provided including a first electric supply circuit, a second electric supply circuit, and a safety device adapted to detect presence or absence of a light bulb in the socket.

U.S. Pat. No. 5,380,214

Inventor: Jerry Ortega

Issued: Jan. 10, 1995

A push-in light socket adapter for use with a conventional household light bulb socket for facilitating a rapid removal and replacement of a light bulb. The adapter includes a threaded socket body which may be engaged to the household light bulb socket in place of the light bulb. The light bulb may then be inserted directly into the adapter without rotating the bulb. The adapter allows a removal of a burnt-out light bulb by a simple pulling motion which releases the bulb from the socket body. A new bulb may then be easily inserted into the adapter by pushing it into the socket body. The light socket adapter further includes an indicator light operable to indicate both a supply of electrical power to the device and a presence of the light bulb within the socket body.

U.S. Pat. No. 5,278,741

Inventor: Moshe Ehrman

Issued: Jan. 11, 1994

An apparatus for fixing rotary heads to an upper drum of a rotary drum of a video cassette recorder includes a guide projection formed on a lower surface of each of the rotary heads, guide grooves formed in the upper drum for engagement with the guide projections of the rotary heads, and setting means for fixing the rotary heads engaged with the guide grooves of the upper drum to the upper drum. The apparatus enables the rotary heads to be mounted on the upper drum simply, accurately, and at constant angular intervals.

U.S. Pat. No. 5,154,628

Inventor: Maer Skegin

Issued: Oct. 13, 1992

A bayonet type socket improved for handling heavy currents of Halogen bulbs has a socket shell with one or more rivet shaped electrical contacts carried by an insulating disc supported on a main spring in the shell. Each rivet contact is movable on the disc and is driven by an auxiliary spring against the base of the light bulb to ensure positive electrical contact. A superior ground connection is provided by a separate grounding element fitted on the socket exterior.

U.S. Pat. No. 4,883,434

Inventor: Akira Toyoshima

Issued: Nov. 28, 1989

A wedge-base lamp and socket assembly includes a wedge-base lamp having a pair of projections formed on opposite sides near the center of a base of the wedge-base lamp; and a socket having a pair of resilient arms which come in engagement with the pair of projections when the wedge-base lamp is mounted within the socket. A single filament type wedge-base lamp has fool-proof projections formed on opposite sides at opposite end portions of the base, and a double filament type wedge base socket has abutment portions which come in engagement with the fool-proof projections when the single filament type wedge-base lamp is inserted into the double filament type socket to thereby prevent erroneous coupling therebetween.

U.S. Pat. No. 4,778,409

Inventor: William H. Maddock

Issued: Oct. 18, 1988

A molded electrical lamp socket includes threaded, insulating portions on the inner wall of the socket to engage the lamp. The side electrode providing electrical contact for the lamp is desirably set deeply within the socket, to reduce the danger of accidental finger contact with an electrically conducting lamp. Where the side electrode is of the edge-on type, the insulating threads center the lamp in the socket and reduce the incidence of shaving and jamming of the lamp. United States Patent U.S. Pat. No. 4,319,796

Inventor: Emmett H. Wiley

Issued: Mar. 16, 1982

A compact lamp unit and associated socket for use in a projection system such as a slide projector, microfilm viewer, and so forth. The lamp unit includes a reflector molded from a plastic material and an electric lamp secured within the reflector. In order to decrease the axial dimension of the reflector and to avoid the use of pin connectors, electrical contacts for the lamp are pressed into recesses formed in the outer surface of the reflector. The reflector includes an opening at its apex through which electrical leads from the lamp extend outwardly of the reflector. The electrical leads are secured to the contacts by being forced into the recesses along with the contacts. This construction technique is fast and simple. The lamp unit also includes a handle to enable a heated lamp unit to be replaced by the user and a guide means to enable the lamp unit to be oriented quickly and accurately upon insertion into the socket. In their preferred forms, the handle and the guide means are identically configured and comprise fins extending outwardly of the convex surface of the reflector, the fins lying on opposite sides of the opening and in the same plane. The socket into which guide means is inserted includes a first upstanding member defining a reference plane against which a portion of the reflector is engaged in use. A second upstanding structure engages another portion of the reflector to securely retain the reflector when it is inserted into the socket. The socket includes a pair of flexible contacts engageable with the contacts carried by the lamp unit, the socket contacts being positioned in a plane substantially parallel with the reference plane. When the lamp unit is inserted into the socket, the socket contacts are flexed sufficiently to make good electrical contact with the contacts carried by the lamp unit. A retention mechanism in the form of a flexible bail may be used to prevent inadvertent displacement of the lamp unit from the socket. United States Patent U.S. Pat. No. 5,989,070

Inventor: Ali Al-Turki

Issued: Nov. 23, 1999

A light bulb-socket adapter for connecting a bayonet type light bulb to an Edison type socket or an Edison type light bulb to a bayonet type socket. The light bulb-socket adapter includes an Edison type connector section made of conductive material and a connection terminal extending therefrom and a bayonet type bulb receiving section and first and second contact terminals positioned within the receiving section for connecting a bayonet type light bulb to an Edison type socket. The light bulb-socket adapter includes a bayonet type connector section and first and second contact terminals extending from the connector section and an Edison type bulb receiving section made of conductive material and a connection terminal extending therefrom for connecting an Edison type light bulb to a bayonet type socket. Each adapter includes a nonconductive barrier layer connected between and electrically isolating said Edison type section and bayonet type section, a first connection wire connecting the conductive material of the Edison type section to the first connection terminal of the bayonet type section and a second connection wire connecting the contact terminal of the Edison type section to the second connection terminal of the bayonet type section. When the adapter is connected between a bulb and socket, the bulb and socket form a complete circuit via the first and second wires respectively.

U.S. Pat. No. 5,800,212

Inventor: Min-Hsun Hsu

Issued: Sep. 1, 1998

An improved plug-in type light bulb including a light bulb with a plug unit and an electrical socket for receiving the light bulb. The socket is comprised of two symmetrical halves each of which includes an upper portion and a lower portion. A cover plate with a notch is disposed inside at the upper portion, while a plurality of grooves are formed at the lower portion. A plurality of electrically conductive plates are disposed in the grooves and each of which has an angular contact terminal. The plug unit has two side walls each of which has an integrally formed raised block and two lateral walls against which the corresponding contact terminals of the lead wires rest. The lateral walls are further provided with a respective half round groove across which the contact terminal is disposed. When the light bulb is inserted into the socket, the angular contact terminals of the conductive plates will fit into the insert grooves of the plug unit of the light bulb and cause a part of the respective contact terminals of the lead wires to fit into the same insert grooves to achieve firm electrical contact.

U.S. Pat. No. 5,595,513

Inventor: Hiroyuki Kondo

Issued: Jan. 21, 1997

A bulb socket terminal to be accommodated in a socket body of a connector bulb socket. The terminal includes a base, an elastic contact portion adapted to contact a filament or an earth of a bulb on one side of the base, and a connecting portion adapted to be connected to a connector on the other side thereof. The bulb socket terminal is integrally formed intermediate of the elastic contact portion and the connecting portion with a resin flow blocking wail which contacts an insert-molding metal mold to seal an area of the elastic contact portion at the time of insert-molding. Accordingly, the area where the elastic contact portion extends is sealed by the rein flow blocking wall at the time of insert-molding with use of the metal mold to thereby prevent the resin from flowing into this area. Therefore, the spring elasticity of the elastic contact portion will not be restricted.

U.S. Pat. No. 4,824,393

Inventor: Joseph M. Armbruster

Issued: Apr. 25, 1989

A socketless light bulb holder in the form of a substantially rigid, plastic bracket including a base affixed to a supporting structure with a generally centrally disposed mounting screw and a pair of terminal screws. The holder also includes a bulb holder portion snugly embracing the base of a light bulb. The terminals on the base of the light bulb are connected to conductor members extending from the terminals on the base of the light bulb to the terminal screws on the base of the holder with the conductor members being soldered to the terminals on the base of the light bulb thereby eliminating the necessity of the light bulb being inserted into and twisted in relation to a light bulb socket in order to mount the light bulb in the socket. In one embodiment of the invention, the holder includes a locking retainer for engagement with one of the bayonet pins which conventionally project radially from the base of the light bulb to mechanically lock the bulb in position. In another embodiment, the holder which snugly engages the base of the light bulb is provided with a slot enabling passage of one of the radially extending pins on the base of the light bulb. The positive soldered connection between the light bulb terminals and the conductor members eliminates points of corrosion which frequently result in the electrical energy supplied to the light bulb becoming interrupted.

While there are other light bulb sockets that may be suitable for the purposes for which they were designed, they would not be as suitable for the purposes of the present invention, as hereinafter described.

SUMMARY OF THE PRESENT INVENTION

A primary object of the present invention is to provide a light bulb socket that facilitates the easy and quick installation and removal of a light bulb.

Another object of the present invention is to provide a light bulb socket having a socket housing for connection to an electrical source and a spring-clamp socket residing therein.

Yet another object of the present invention is to provide a light bulb socket that has a notched spring-clamp socket that flexes for the insertion or removal of a light bulb Still yet another object of the present invention is to provide light bulb socket that has a spring-clamp socket that is fabricated of a resilient material.

Yet another object of the present invention is to provide light bulb socket that is available in sizes to accommodate existing light bulb sockets.

Additional objects of the present invention will appear as the description proceeds.

The present invention overcomes the shortcomings of the prior art by providing a socket for a light bulb having a socket housing to provide wired connection and an interior spring-clamp socket manufactured of a resilient material and having a notched separation extending longitudinally therethrough. The notch permits the deformation of the spring-clamp socket and expands when a light bulb is inserted and grasps it once therein. Removal of the bulb simply requires pulling the bulb straight out. Additionally the present invention is adaptable and replaceable for most existing lighting fixtures or applications.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
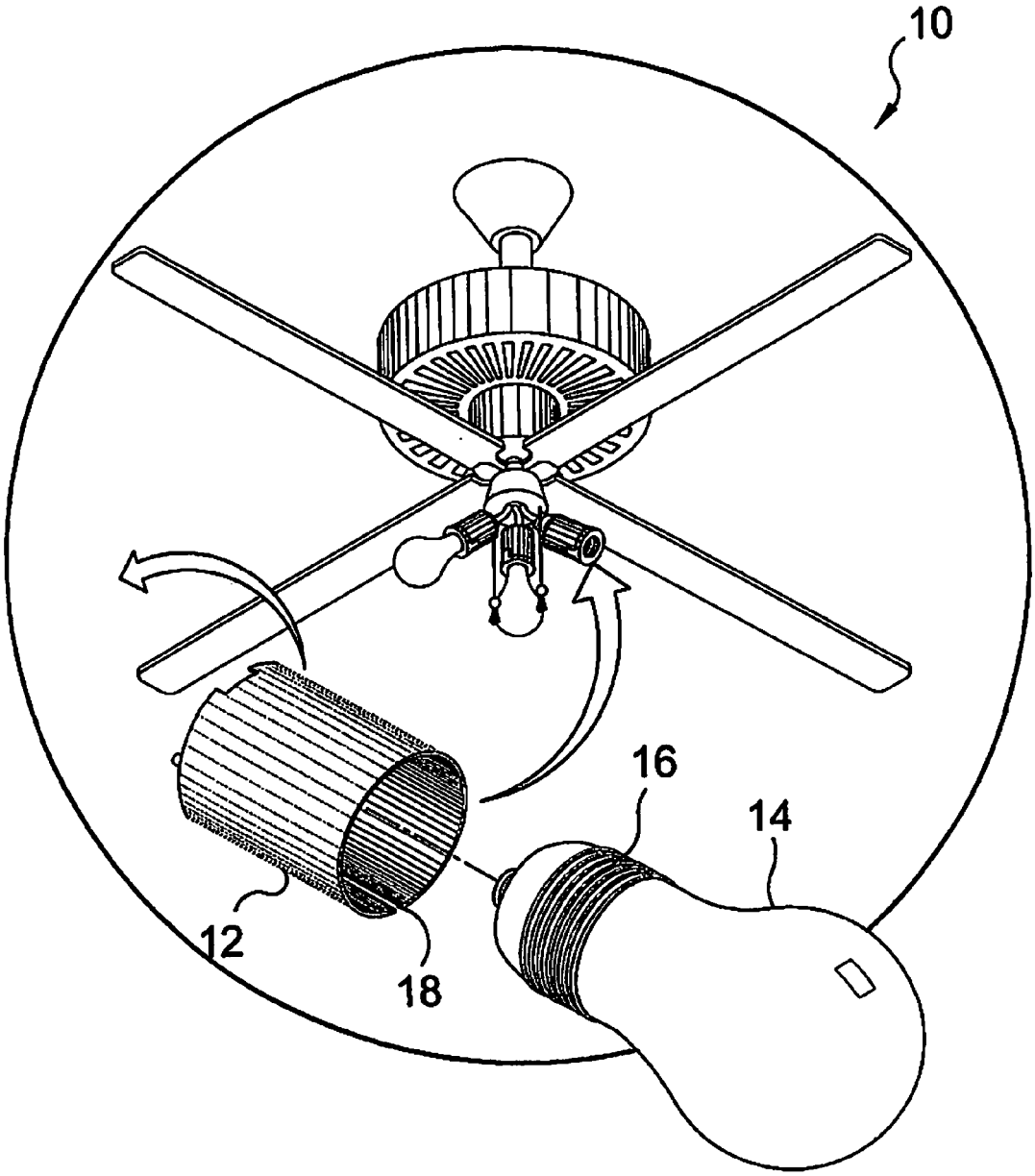
FIG. 1 is an illustrative view of the present invention in use.

Turning now descriptively to the drawings, in which similar reference characters denote similar elements throughout the several views, the figures illustrate the Spring-Clamp Light Bulb Socket Assembly of the present invention. With regard to the reference numerals used, the following numbering is used throughout the various drawing figures.

10 Spring-Clamp Light Bulb Socket Assembly of the present invention
12 spring-clamp socket
13 socket housing
14 light bulb
16 threaded base of 14
18 notch of 12
20 interior of 12
22 electrical contact
24 screw
26 positive contact
28 negative contact
30 threaded mounting recess
32 socket mounting apertures
34 mounting foot
36 mounting foot recess
38 bottom plate of 13

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention in use 10. The present invention 10 is a light bulb socket 12 having a substantially smoothbore bulb-receiver socket 12 with a longitudinally disposed notch 18 that enables the socket 12 to expand to grip the bulb therein thereby forming a spring clamp socket 12. The socket 12 is retained within a housing 13. The socket 12 frictionally engages the light bulb base 16 as the bulb 14 is pressed into socket interior 20 until seated. To remove the light bulb 14, the light bulb 14 is pulled from the socket 12 without the need for twisting, turning, aligning or the use of tools. The present invention 10 provides a light bulb socket 12 where a user simply pushes a light bulb 14 into the resilient tension socket 12 and to replace the bulb 14, the light bulb 14 is pulled out of the socket 12 and another bulb 14 is pressed into service.

Figure 2:
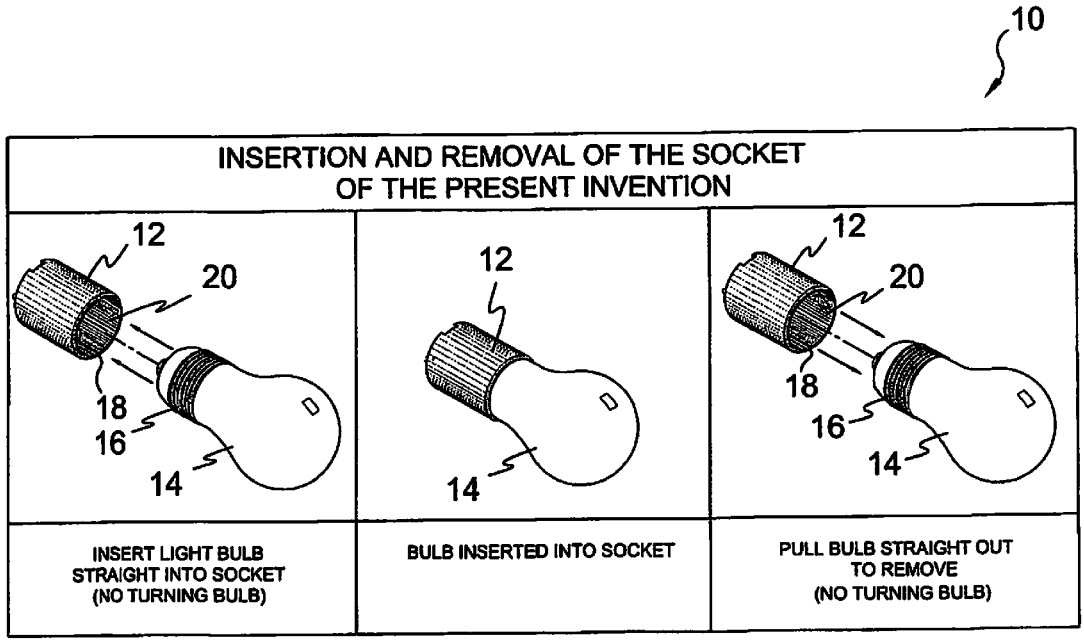
FIG. 2 is an illustrative chart of the present invention.

FIG. 2 is a perspective view of the steps involved in installing and removing a light bulb 14 from the present invention 10. Shown are the steps taken for the installation and removal of a light bulb 14 from the socket 12 being first the placement of slipping the threaded base 16 of the bulb 14 into the socket interior 20 where it is retained in electrical communication within the socket 12, then to remove the bulb 14 the user simply pulls the bulb 14 till deformation of the socket 14 by separating the notch 18 is increased to a point where the bulb 14 may be dislodged.

Figure 3:
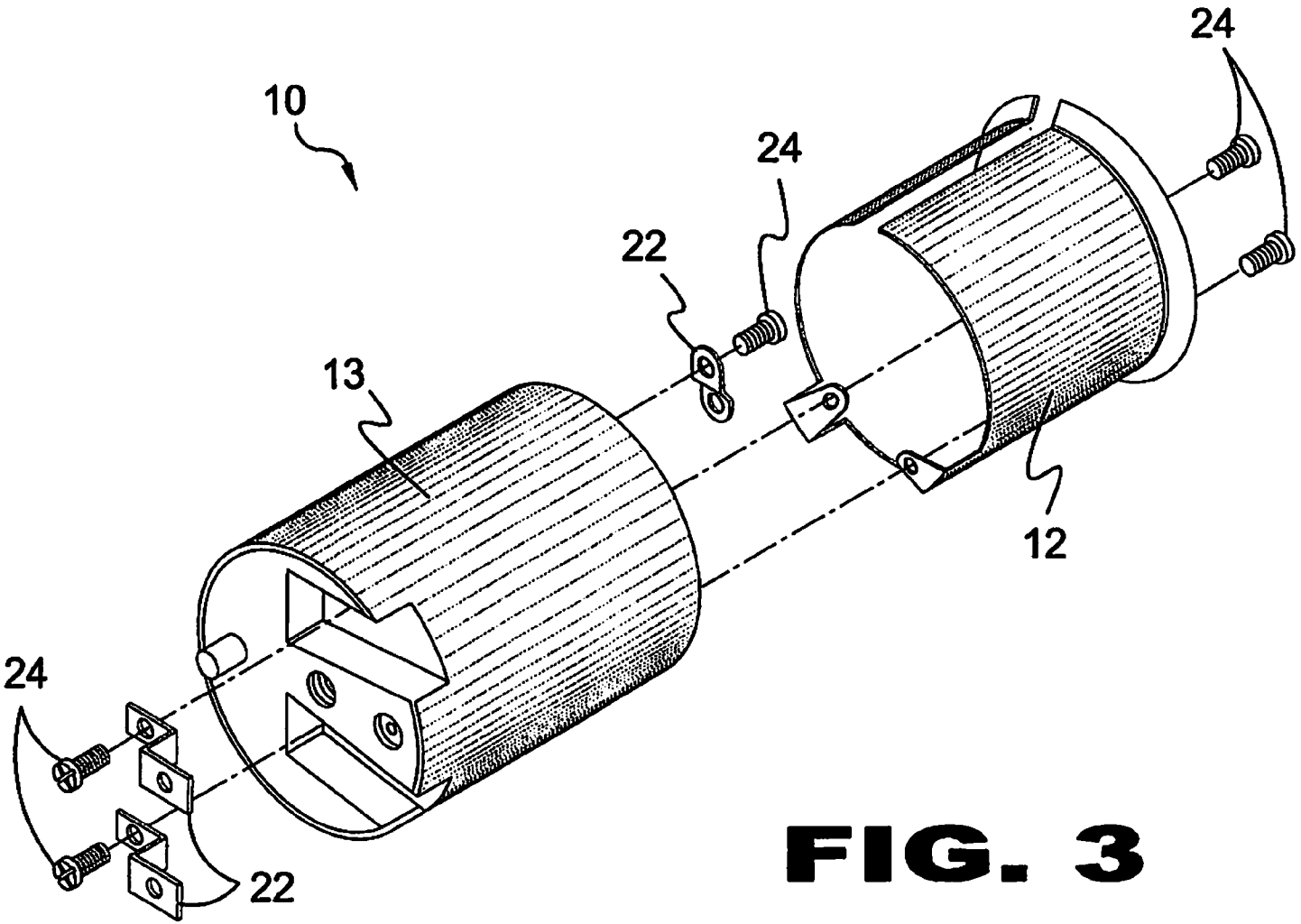
FIG. 3 is an exploded perspective view of the present invention.

FIG. 3 is an exploded perspective view of the present invention 10. Shown is the present invention 10, an electric socket 12 for a standard light bulb having a spring-clamp socket 12 within a socket housing 13 with a center contact 22 and two wire contacts 22 held in place by screws 24. The spring clamp action of the socket 12 is provided by the notch disposed therein.

Figure 4:
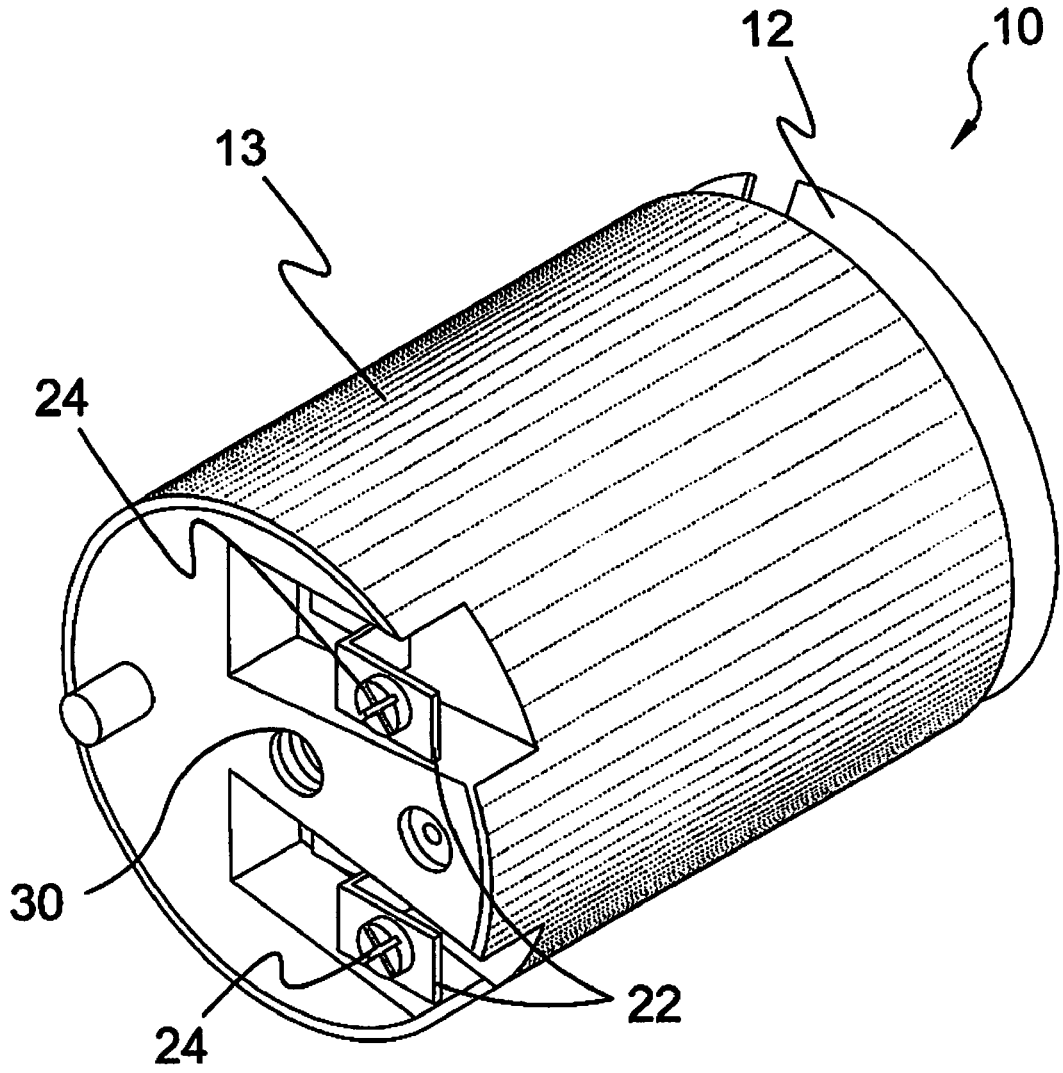
FIG. 4 is a rear perspective view of the present invention.

FIG. 4 is a rear perspective view of the present invention 10. Shown is a rear perspective view of the socket of the present invention 10 having a spring-clamp socket 12 within a socket housing 13. Also shown are the electrical contacts 22 held in place by screws 24. Centrally disposed in the bottom is a threaded mounting recess 30 for securing the socket to a lighting fixture. The light bulb is frictionally held therein until selectively released simply by pulling it out.

Figure 5:
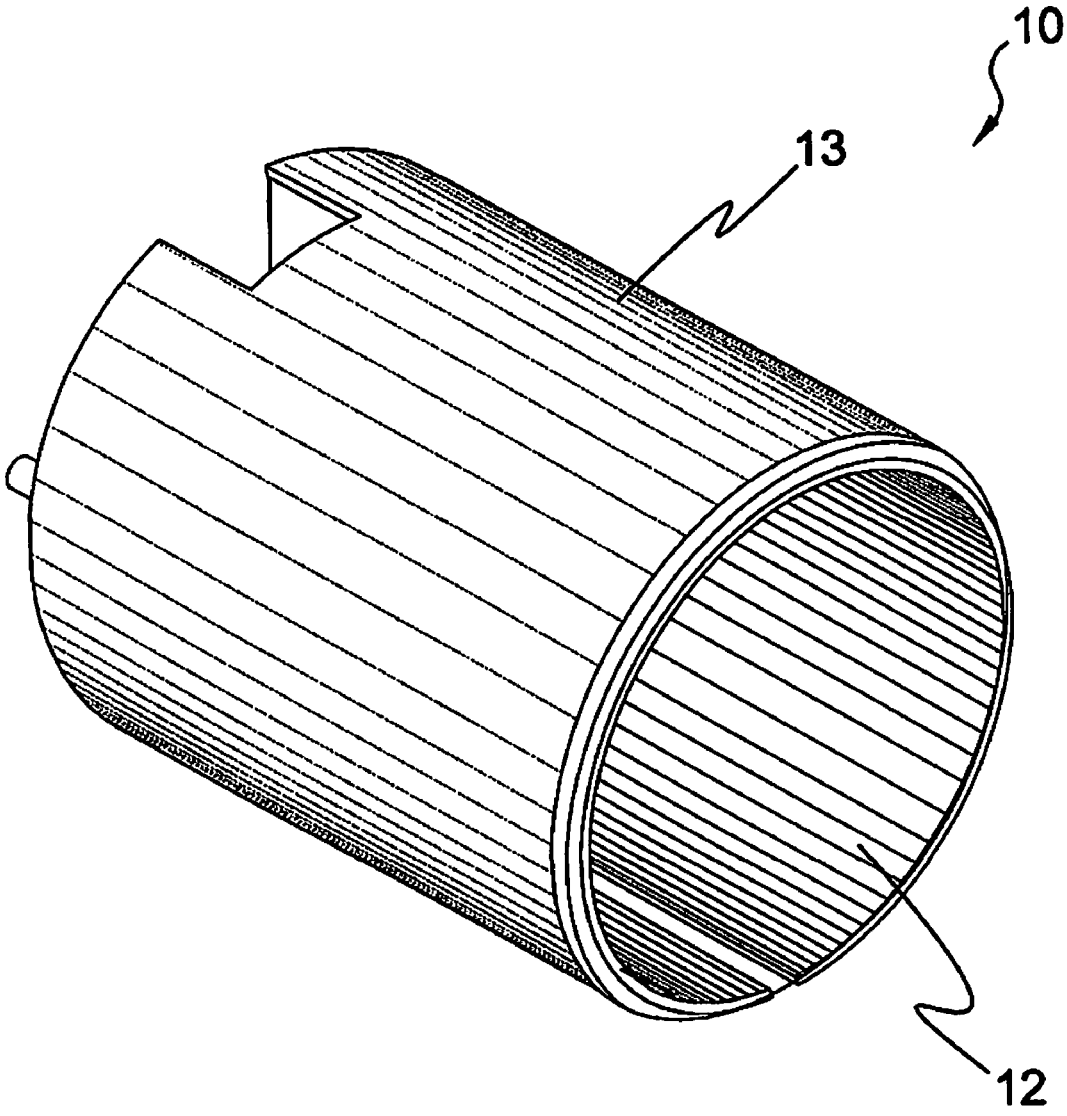
FIG. 5 is an assembled perspective view of the present invention.

FIG. 5 is an assembled perspective view of the present invention 10. Shown is the spring-clamp socket 12 inserted into the socket housing 13.

Figure 6:
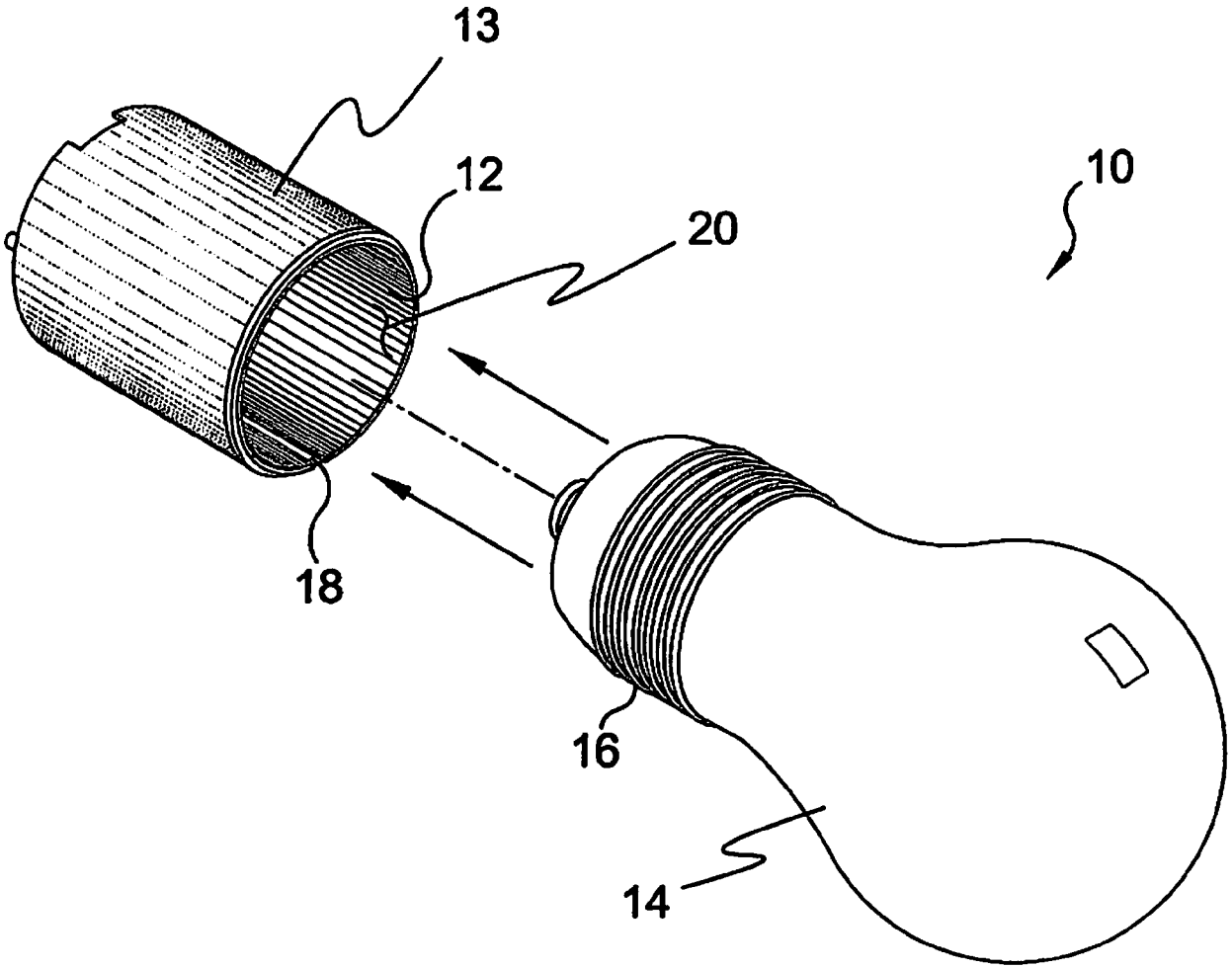
FIG. 6 is an illustrative view of the present invention.

FIG. 6 is a perspective view of a conventional light bulb 14 about to be inserted into the socket of the present invention 10. The present invention 10 is an electric socket for a standard light bulb 14 having a spring-clamp socket 12 within a socket housing 13 such that the light bulb threaded base 16 is inserted or removed from the socket interior 20 by pulling to remove or pushing to insert. The light bulb 14 is held therein by the spring-clamp action of the notch 18 which allows the socket 12 to frictionally engage and make electrical contact with the light bulb 14.

Figure 7:
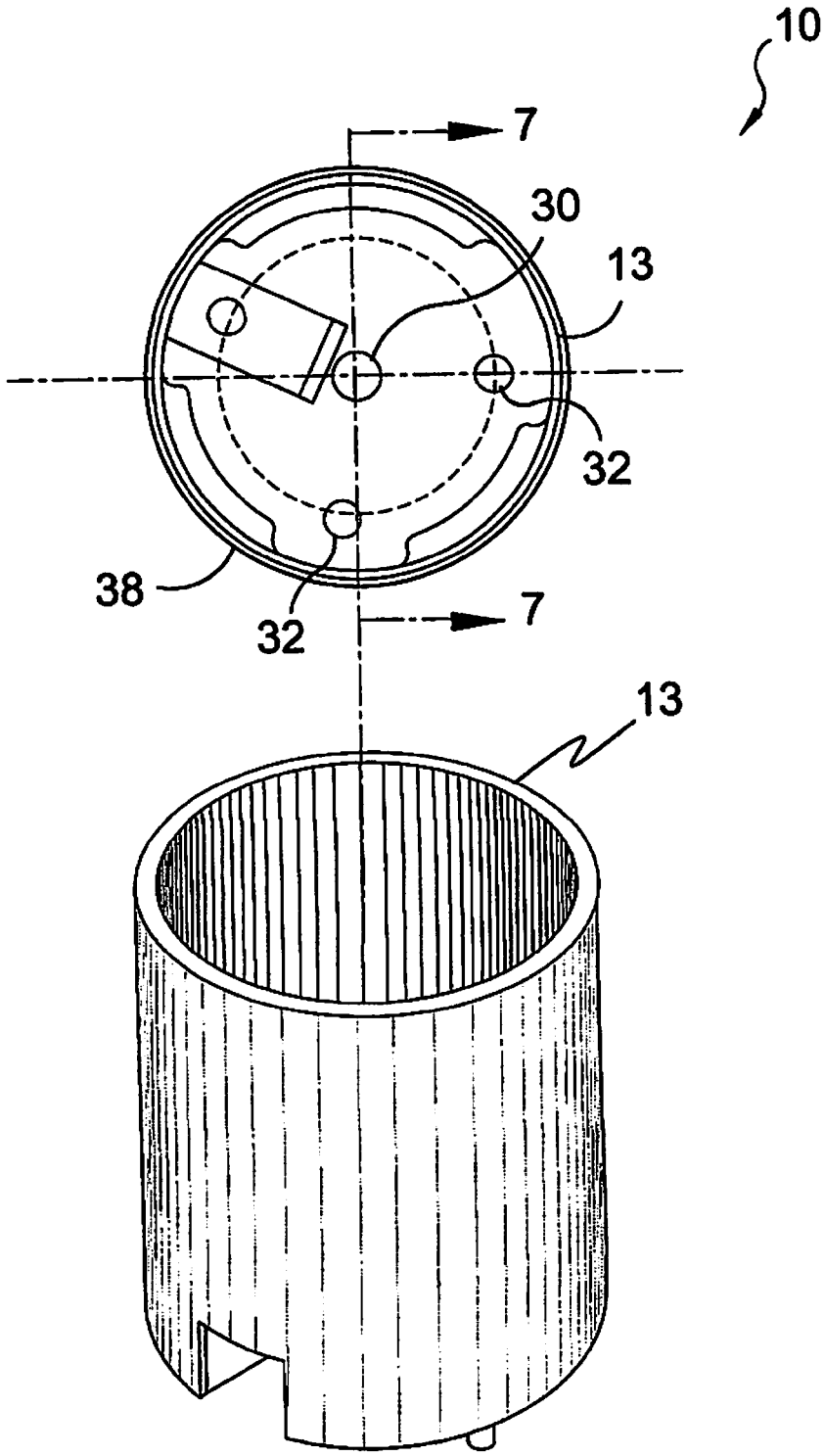
FIG. 7 is a projection view of the socket housing of the present invention.

FIG. 7 is a projection view of the socket housing 13 of the present invention 10. The present invention 10 is an electric socket for a standard light bulb having a spring-clamp socket within a socket housing 13 such that the light bulb threaded base is inserted or removed from the spring-clamp by pulling to remove or pushing to insert. The light bulb is frictionally held within the spring-clamp until selectively withdrawn. Also shown is the bottom plate 38 with mounting recess 30 and the socket mounting apertures 32 that are use to fasten the spring-clamp socket thereto.

Figure 8:
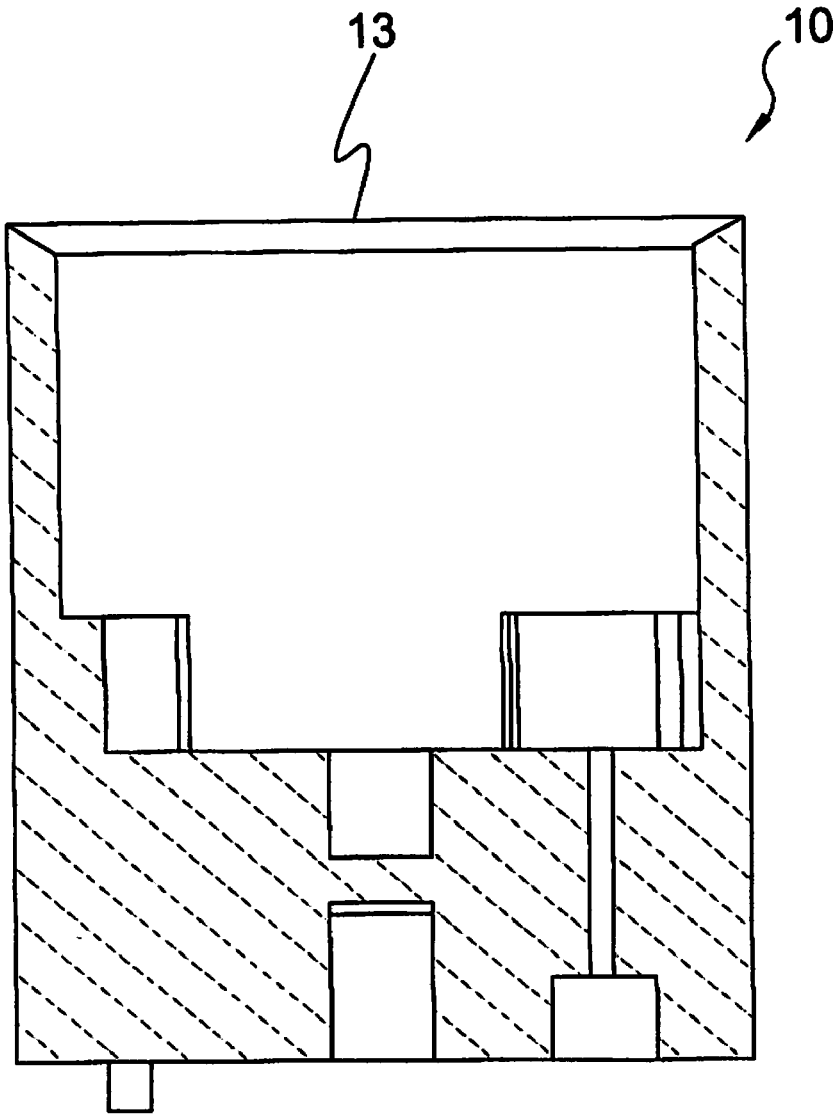
FIG. 8 is a cross sectional view of the socket housing of the present invention.

FIG. 8 is a cross sectional view of the socket housing 13 of the present invention 10 taken from FIG. 7 as indicated.

Figure 9:
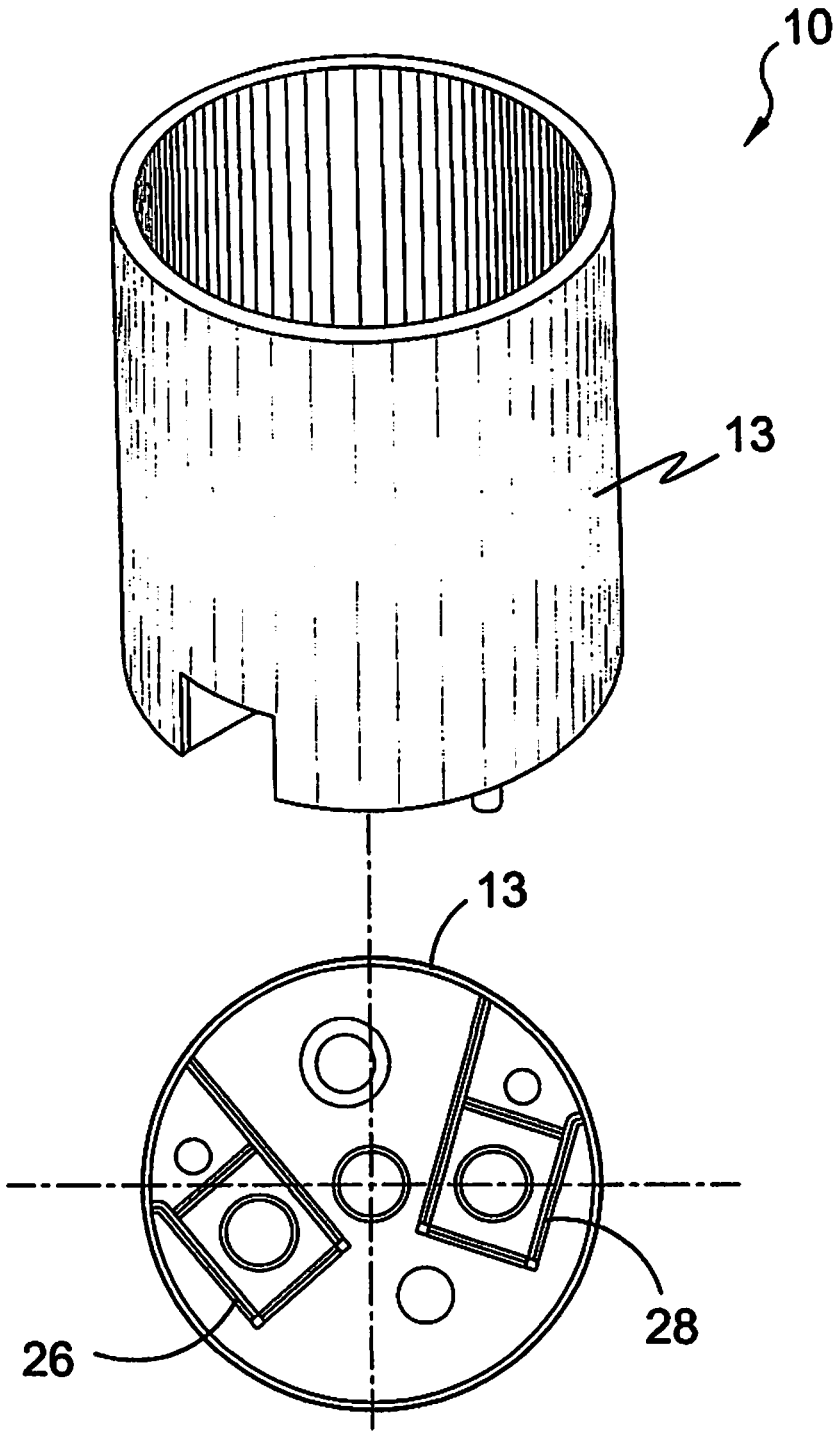
FIG. 9 is a projection view of the socket housing of the present invention.

FIG. 9 is a projection view of the socket housing 13 present invention 10. The socket housing 13 includes a positive contact 26 and a negative contact 28 for providing electricity to the bulb.

Figure 10:
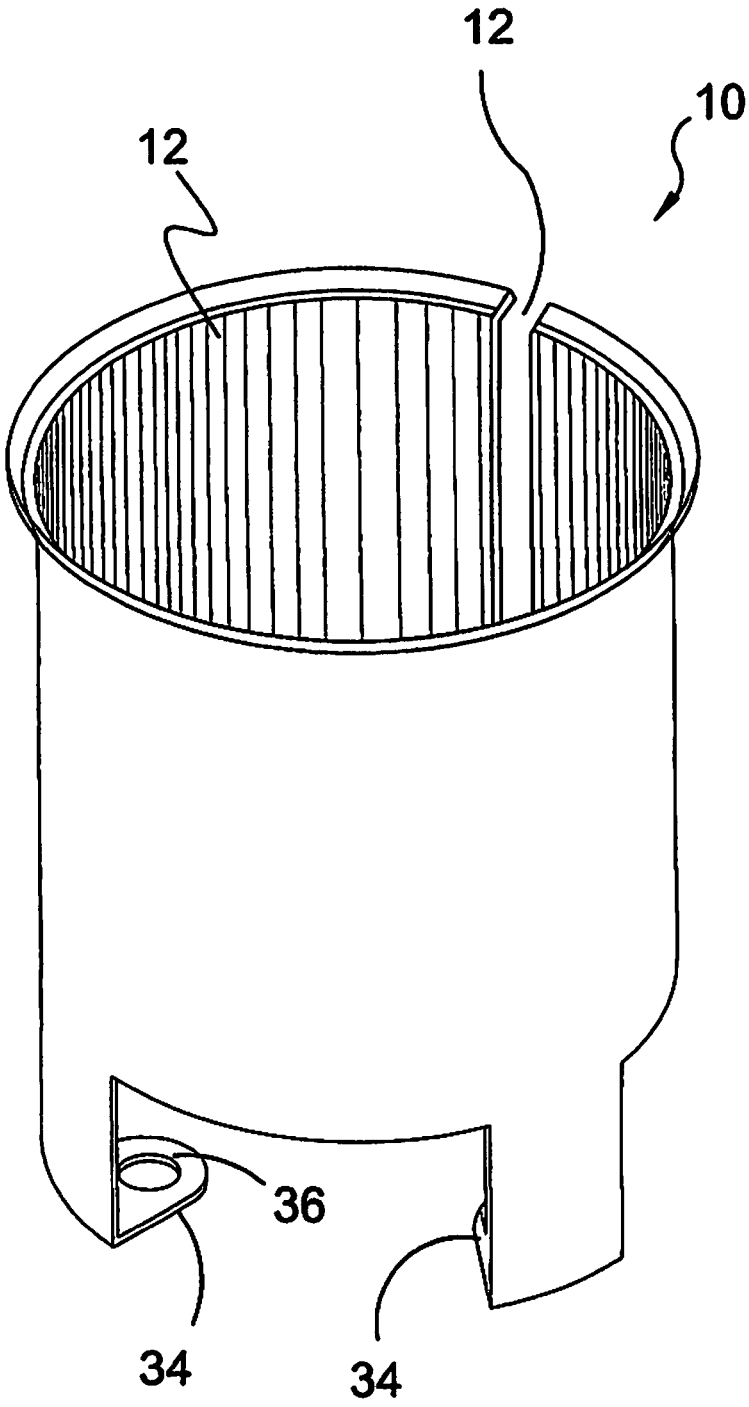
FIG. 10 is a perspective view of the spring-clamp socket of the present invention.

FIG. 10 is a perspective view of the spring-clamp socket 12 of the present invention 10. The spring-clamp socket 12 has a notch 18 that provides the deformability thereof to frictionally engage and hold the light bulb therein. A pair of mounting feet 34 project from the bottom and have recesses 36 to secure the spring-lamp socket 12 to the socket housing.

Figure 11:
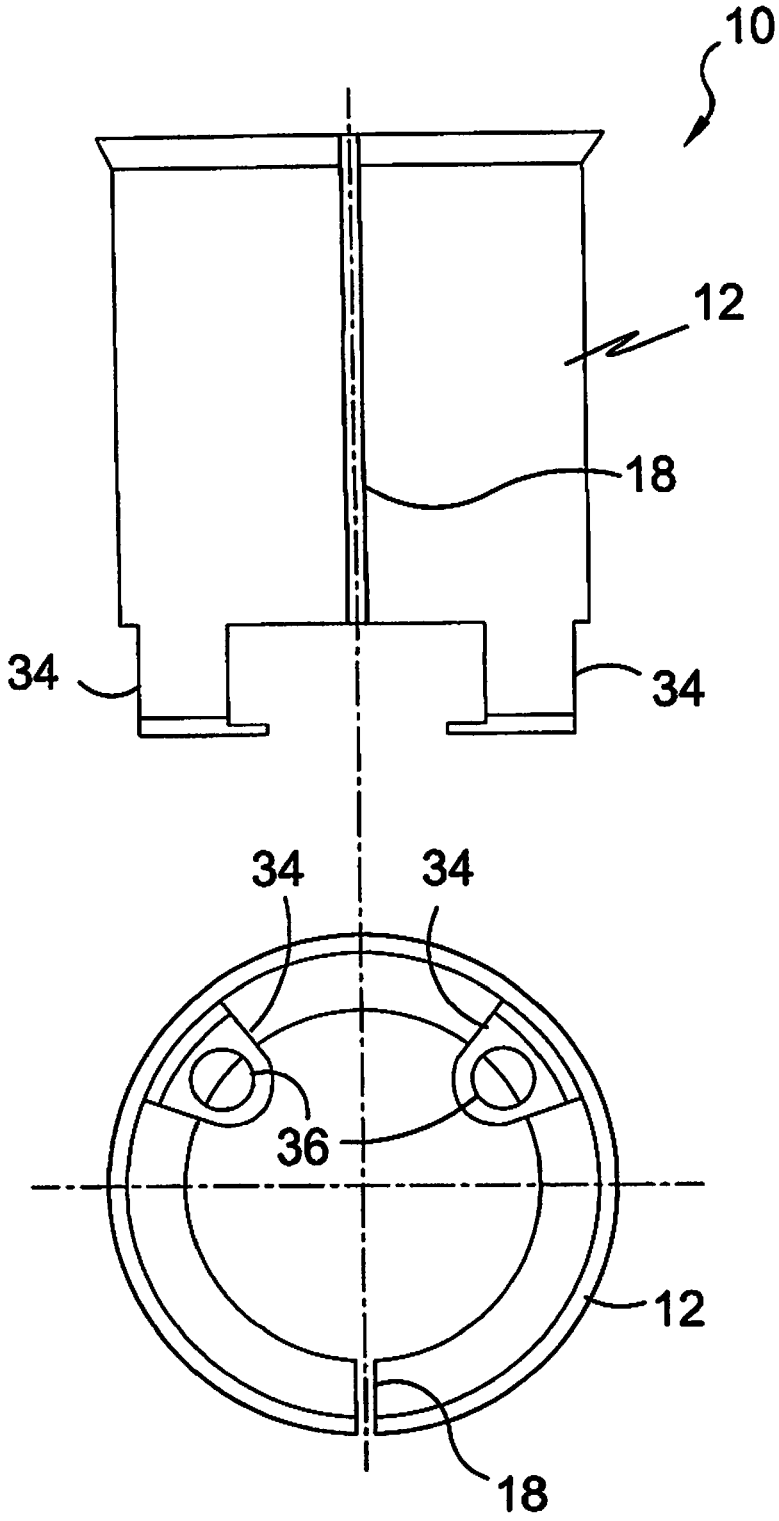
FIG. 11 is a projection view of the spring clamp socket of the present invention.

FIG. 11 is a projection view of the spring-clamp socket 12 of the present invention 10. The spring-clamp socket 12 has a notch 18 that provides the deformability thereof to frictionally engage and hold the light bulb therein. A pair of mounting feet 34 project from the bottom and have recesses 36 to secure the spring-clamp socket 12 to the socket housing.

Figure 12:
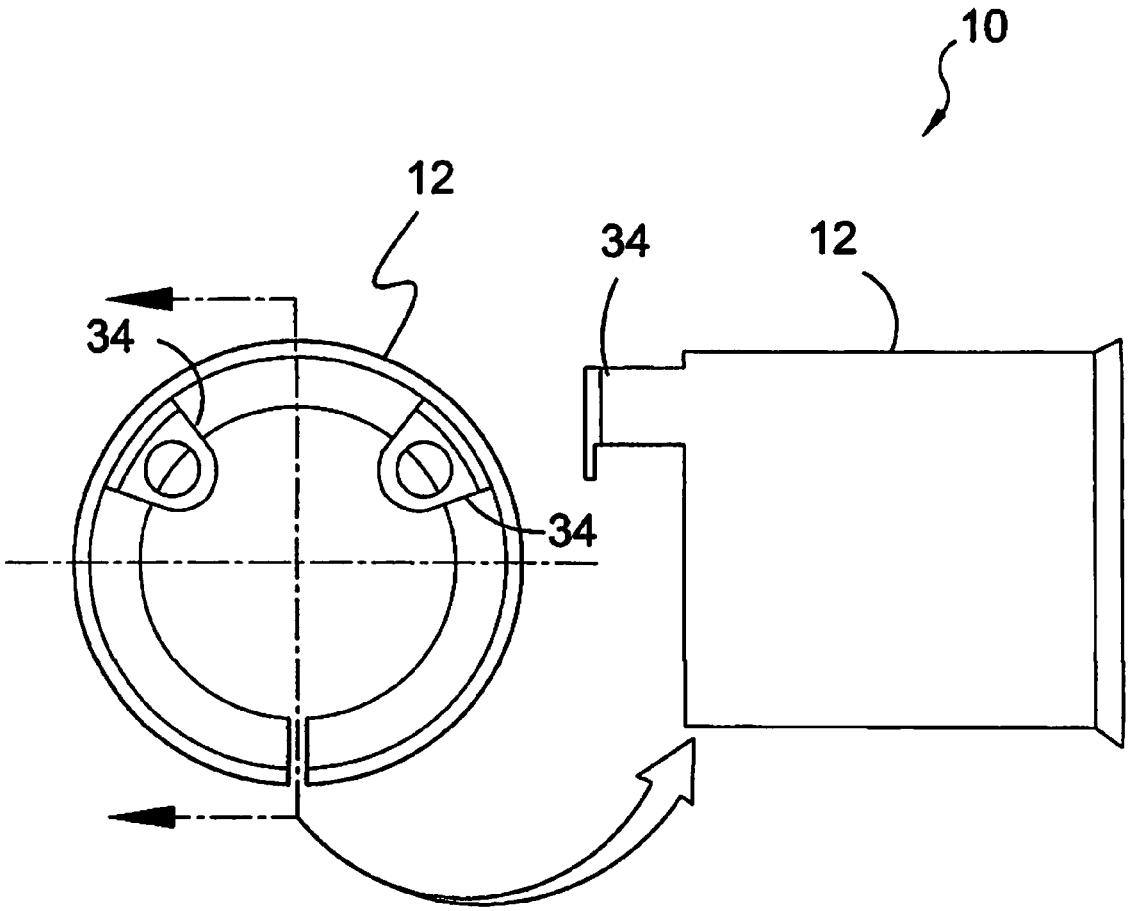
FIG. 12 is a projection view of the spring-clamp socket of the present invention.

FIG. 12 is a projection view of the spring-clamp socket 12 of the present invention 10. The spring-clamp socket 12 has a notch 18 that provides the deformability thereof to frictionally engage and hold the light bulb therein. A pair of mounting feet 34 project from the bottom and have recesses 36 to secure the spring-clamp socket 12 to the socket housing.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is new and desired to be protected by Letters Patent is set forth in the appended claims:

1. A spring-clamp socket assembly that receives and maintains a light bulb therein without the need of threading or turning the light bulb during insertion and extraction, said socket assembly consisting of:

a) a socket housing having an opening at one end;

b) a spring-clamp socket of resilient material inserted through said opening of said socket housing and secured within said socket housing; and c) a single notch extending through a full length of a wall of said spring-clamp socket enabling edges of said wall defining said notch to expand during insertion of a light bulb base thereby securing said light bulb in place within said spring-clamp socket while allowing said light bulb to be withdrawn by pulling said light bulb out of said spring-clamp socket;

d) said socket housing having a substantially enclosing bottom plate with a threaded opening; and e) said bottom, plate having electrical contacts for providing electricity to the bulb.

2. The spring-clamp socket assembly recited in claim 1, wherein said spring-clamp socket is a substantially hollow cylinder.

3. The spring-clamp socket assembly recited in claim 2, wherein said spring-clamp socket further includes a pair of mounting feet projecting from a bottom portion thereof and terminating with medially oriented right angle projections.

4. The spring-clamp socket assembly recited in claim 3, wherein each said mounting foot has a recess disposed on the bottom thereof.

5. The spring-clamp socket assembly recited in claim 4, wherein said bottom plate includes threaded socket mounting apertures corresponding with said mounting foot recesses for accepting screws to secure said spring-clamp socket within said socket housing.

* * * * *